US010400575B2

(12) United States Patent
Cristurean et al.

(10) Patent No.: US 10,400,575 B2
(45) Date of Patent: Sep. 3, 2019

(54) SPIDER FOR DOWNHOLE TOOL

(71) Applicant: Schlumberger Technology Corporation, Sugar Land, TX (US)

(72) Inventors: Andi Lucian Dorin Cristurean, Katy, TX (US); Mihai Silviu Calin, Calgary (CA)

( * ) Notice: Subject to any disclaimer, the term of this patent is extended or adjusted under 35 U.S.C. 154(b) by 215 days.

(21) Appl. No.: 15/320,634

(22) PCT Filed: Jun. 18, 2015

(86) PCT No.: PCT/CA2015/050563
§ 371 (c)(1),
(2) Date: Dec. 20, 2016

(87) PCT Pub. No.: WO2015/192244
PCT Pub. Date: Dec. 23, 2015

(65) Prior Publication Data

US 2017/0191362 A1 Jul. 6, 2017

Related U.S. Application Data

(60) Provisional application No. 62/015,201, filed on Jun. 20, 2014.

(51) Int. Cl.
*E21B 17/16* (2006.01)
*E21B 47/01* (2012.01)

(52) U.S. Cl.
CPC ..... *E21B 47/01* (2013.01); *E21B 17/16* (2013.01)

(58) Field of Classification Search
CPC ..... E21B 17/16; E21B 17/18
See application file for complete search history.

(56) References Cited

U.S. PATENT DOCUMENTS 1,909,075 A * 5/1933 Ricker ..... E21B 17/18 138/113
2,494,803 A * 1/1950 Frost ..... E21B 17/18 138/114

(Continued)

FOREIGN PATENT DOCUMENTS

WO 2014071494 A1 5/2014

OTHER PUBLICATIONS

International Search Report and Written Opinion issued in International Patent application PCT/CA2015/050563 dated Sep. 3, 2015, 7 pages.

(Continued)

*Primary Examiner* — Kenneth L Thompson

(57) ABSTRACT

A spider for a downhole tool, comprises: an inner rim; an outer rim; and at least two spokes extending radially between and connected to the inner and outer rims. The spider can be selected from a group consisting of grounding spiders, landing spiders, and centralizers. The at least two spokes comprise a first spoke in a first row and a second spoke in a second row that is axially offset from the first row; the second spoke can be circumferentially offset from the first spoke. The second row can be at a drilling fluid inlet end of the spider, and the first row can be at a drilling fluid outlet end of the spider. Each row defines a transverse plane having a flow area that is sufficient for drilling fluid flowing through the spider to at least meet a minimum target flow rate under specified operating conditions.

20 Claims, 14 Drawing Sheets

(56) References Cited

U.S. PATENT DOCUMENTS

| | | | | |
|---|---|---|---|---|
| 2,850,264 | A * | 9/1958 | Grable | E21B 17/10 175/69 |
| 3,786,878 | A * | 1/1974 | Chapman | E21B 17/18 175/106 |
| 4,207,925 | A * | 6/1980 | Nelson | E21B 17/04 138/115 |
| 4,280,535 | A * | 7/1981 | Willis | F16L 7/00 138/112 |
| 4,337,563 | A * | 7/1982 | Becker | B23P 11/02 138/148 |
| 4,786,088 | A * | 11/1988 | Ziu | F16L 7/00 138/113 |
| 5,862,834 | A * | 1/1999 | Ziu | F16L 7/00 138/108 |
| 6,026,915 | A | 2/2000 | Smith et al. | |
| 9,016,367 | B2 * | 4/2015 | Wright | E21B 43/2401 166/242.3 |
| 2008/0314585 | A1 | 12/2008 | Clark | |
| 2011/0041934 | A1 * | 2/2011 | Holler | F16L 39/005 137/561 R |
| 2013/0206401 | A1 | 8/2013 | Bhoite et al. | |

OTHER PUBLICATIONS

International Preliminary Report on Patentability issued in International Patent application PCT/CA2015/050563, dated Dec. 20, 2016, 4 pages.

* cited by examiner

SPIDER FOR DOWNHOLE TOOL

FIELD

This invention relates generally to a spider for a downhole tool used in downhole drilling, such as a measurement-while-drilling (MWD) tool or a logging-while-drilling (LWD) tool.

BACKGROUND

Modern drilling techniques employ an increasing number of sensors in downhole tools to determine downhole conditions and parameters such as pressure, spatial orientation, temperature, gamma ray count etc. that are encountered during drilling. These sensors can be employed in a process called 'measurement while drilling' (MWD). The data from such sensors are either transferred to a telemetry device, and thence up-hole to the surface, or are recorded in a memory device by 'logging'.

The sensors and telemetry devices are typically part of a MWD tool, which forms part of a bottom hole assembly ("BHA") of a drill string that is inserted into a borehole of a well. The MWD tool is housed in a tubular drill collar, and in particular is centered within the collar with enough annular space between the drill collar inner wall and the MWD tool to allow drilling fluid to flow through the annular space to a drilling motor located below the MWD tool and remove drilling cuttings. Some MWD tools are collar mounted, whereas other MWD tools are collar loaded. One or more spiders are used to center and affix a collar loaded MWD tool within the drill collar.

Known spiders comprise an inner rim ("neck") for coupling to the tool, an outer rim for coupling to the drill collar, and a plurality of spokes that interconnect the inner and outer rims. The spokes extend radially between the rims and are longitudinally aligned in the axial direction. The components of the spider are designed to provide sufficient strength, stability and toughness to withstand the drilling conditions (e.g. temperature, pressure, vibration, shock and erosion) and yet provide sufficient flow area to allow the drilling fluid to flow at or above a minimum flow rate required to power the drilling motor. These competing criteria create a challenge for designers to create effective spiders, particularly for extreme drilling conditions.

SUMMARY

According to one aspect of the invention, there is provided a spider for a downhole tool, comprising: an inner rim; an outer rim; and at least two spokes extending radially between and connected to the inner and outer rims. The spider can be selected from a group consisting of grounding spiders, landing spiders, and centralizers. The at least two spokes comprise a first spoke in a first row and a second spoke in a second row that is axially offset from the first row; the second spoke can also be circumferentially offset from the first spoke. The second row can be at a drilling fluid inlet end of the spider, and the first row can be at a drilling fluid outlet end of the spider. Each row defines a transverse plane having a flow area that is sufficient for drilling fluid flowing through the spider to at least meet a minimum target flow rate under specified operating conditions.

The spider can have one spoke per row. More particularly, the spider can comprise two spokes, namely a first spoke in the first row and a second spoke in the second row. The second spoke can be circumferentially offset from the first spoke by an angle between 90 and 270 degrees. For example, the second spoke can be circumferentially offset from the first spoke by an angle of about 180 degrees.

Alternatively, the spider can have two spokes per row. More particularly, the spider can comprise four spokes, namely a first pair of spokes in the first row and a second pair of spokes in the second row. The spokes in each pair can be circumferentially spaced 180° apart. Further, the second pair of spokes can be circumferentially offset from the first pair of spokes by 90°.

BRIEF DESCRIPTION OF DRAWINGS

FIG. 1(*b*) is a perspective view of the spider shown in FIG. 1(*a*) sectioned along an axial plane. FIGS. 1(*c*) and (*d*) are perspective views of the spider shown in FIG. 1(*a*) sectioned in a transverse plane along a first and a second spoke of the spider, respectively.

FIG. 3(*b*) is a side view of the spider shown in FIG. 3(*a*) sectioned along an axial plane.

FIGS. 4(*b*) and (*c*) are perspective views of the spider shown in FIG. 4(*a*) sectioned in a transverse plane along a first and a second spoke row of the spider, respectively.

FIG. 6(*b*) is a side view of the spider shown in FIG. 6(*a*) sectioned along an axial plane.

DETAILED DESCRIPTION

Directional terms such as "axially", "transversely", "longitudinally", "upwards", "downwards", "vertically" and "laterally" are used in the following description for the purpose of providing relative reference only, and are not intended to suggest any limitations on how any article is to be positioned during use, or to be mounted in an assembly or relative to an environment.

Figure 7:
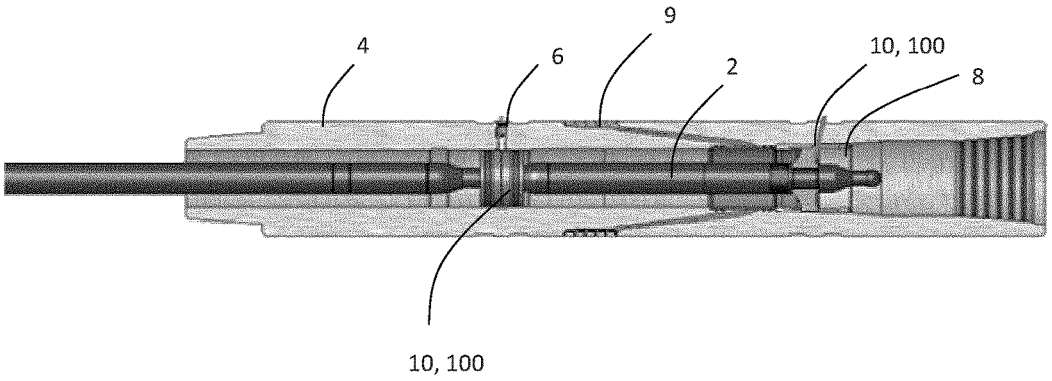
FIG. 7 is a side sectioned view of a collar loaded MWD tool comprising a spider according to one of the embodiments.

The embodiments described herein relate generally to a spider for a downhole tool used in downhole drilling applications, including but not restricted to grounding spiders, landing spiders, and centralizers used in MWD and LWD tools. Each embodiment of the spider comprises at least two rows of spokes, wherein each row are axially offset from one another, i.e. are located at a different axial position along the spider. The illustrated embodiments show spiders with one or two spokes per row; however, other embodiments can comprise more than two spokes per row. All embodiments will thus have at least two axially offset spokes. As an example, FIG. 7, shows a collar loaded MWD tool 2 comprising a pair of spiders 10, 100 according to the embodiments described herein. The spiders 10, 100 couple and center the tool 2 to a drill collar 4. One of the spiders 10, 100 is a grounding spider that is located adjacent to a pressure port 6 in the collar 4 and on one side of the tool 2, and the other spider 10, 100 is a landing spider that is locked in a key sleeve 8 and on the other side of the tool 2. The tool 2 is located across an electrically isolating dielectric gap 9.

The spider 10, 100 also comprises an inner rim coupled to the rest of the downhole tool, and an outer rim coupled to a drill collar; the spokes interconnect the inner and outer rims. The dimensions and geometries of the inner and outer rims and the spokes are selected to create a drilling fluid flow path through the spider that enables a drilling fluid under specified operating conditions (including pressure, temperature) to meet a minimum target flow rate dictated by the operational requirements of a drilling motor located downhole from the downhole tool. It is expected that axially offsetting the spokes of the spider 10, 100 will enable more robust spider components to be used compared to a conventional (non-offset spoke) spider designed to meet the same minimum target flow rate, or to enable a greater flow rate to be achieved compared to a conventional spider when using the same component dimensions and geometries as the conventional spider.

Figure 1A:
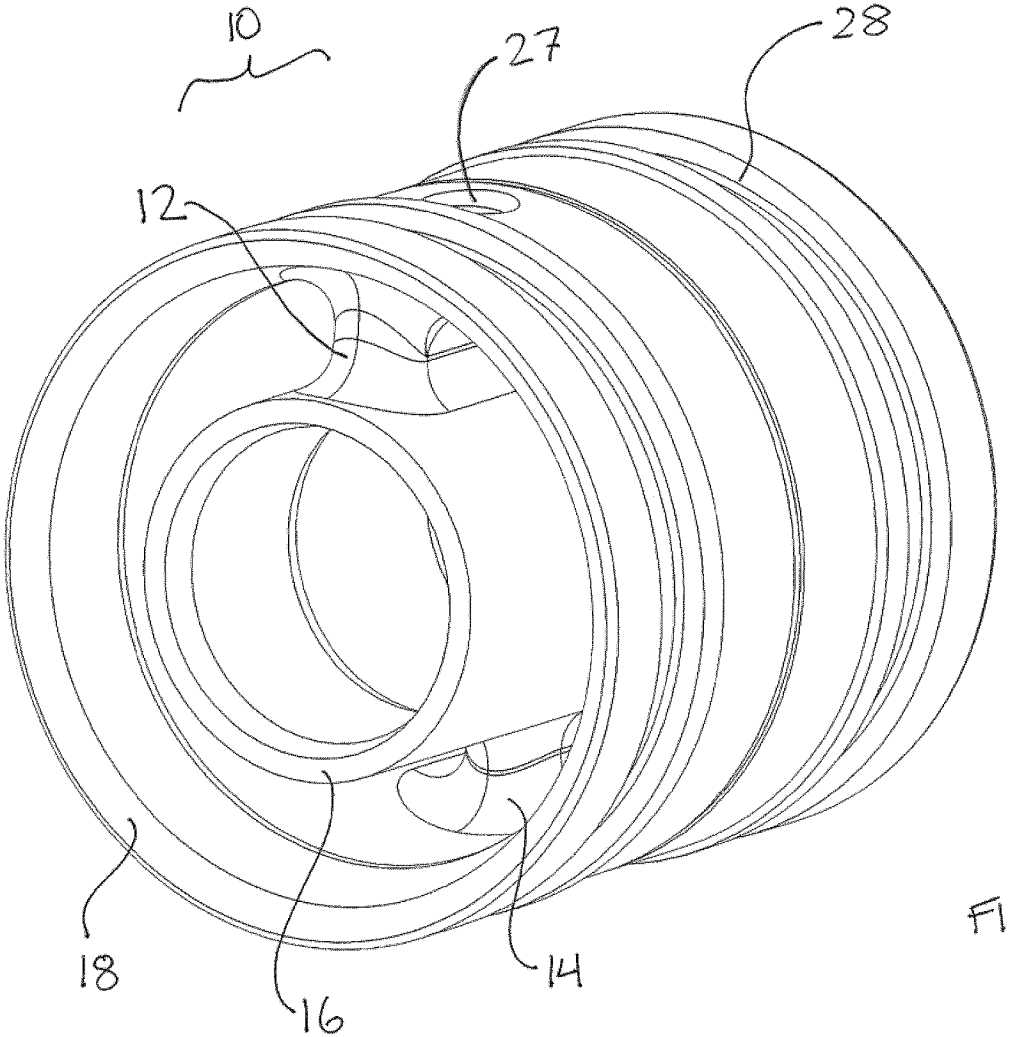
FIG. 1(*a*) is a perspective view of an offset two-spoke spider for a downhole tool according to a first embodiment.
Figure 1B:
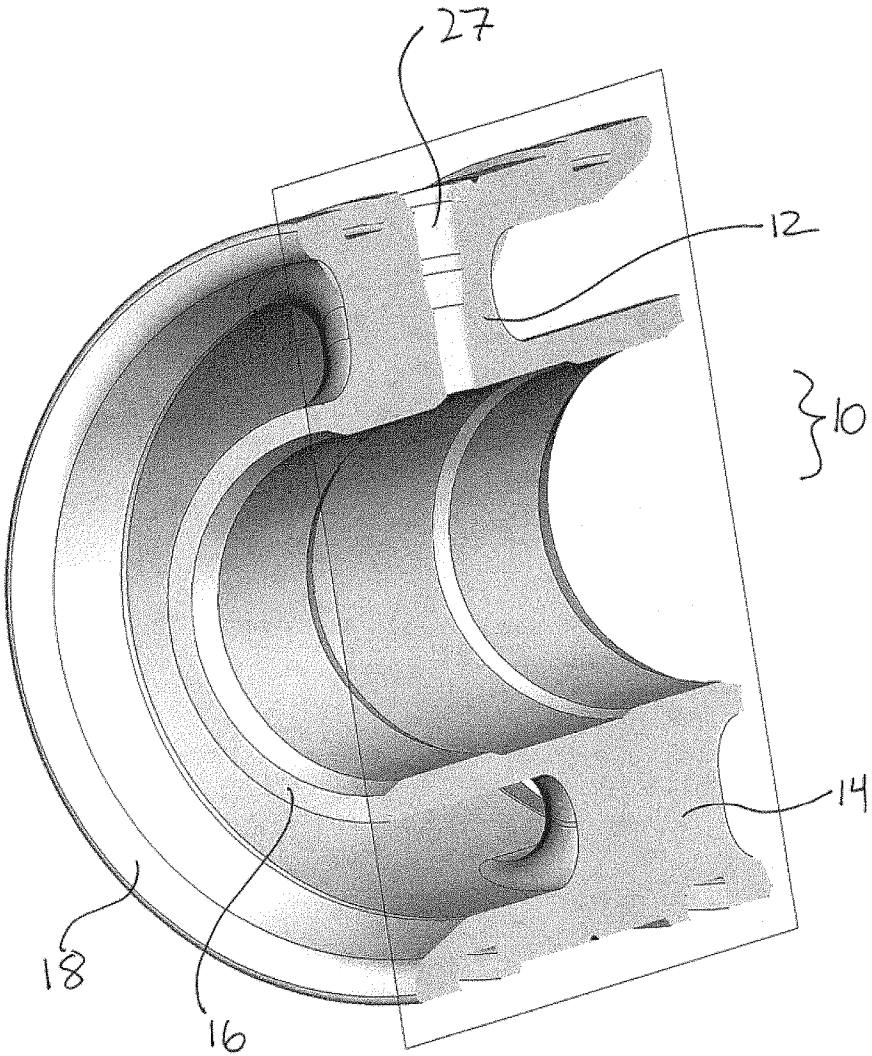
Figure 1C:
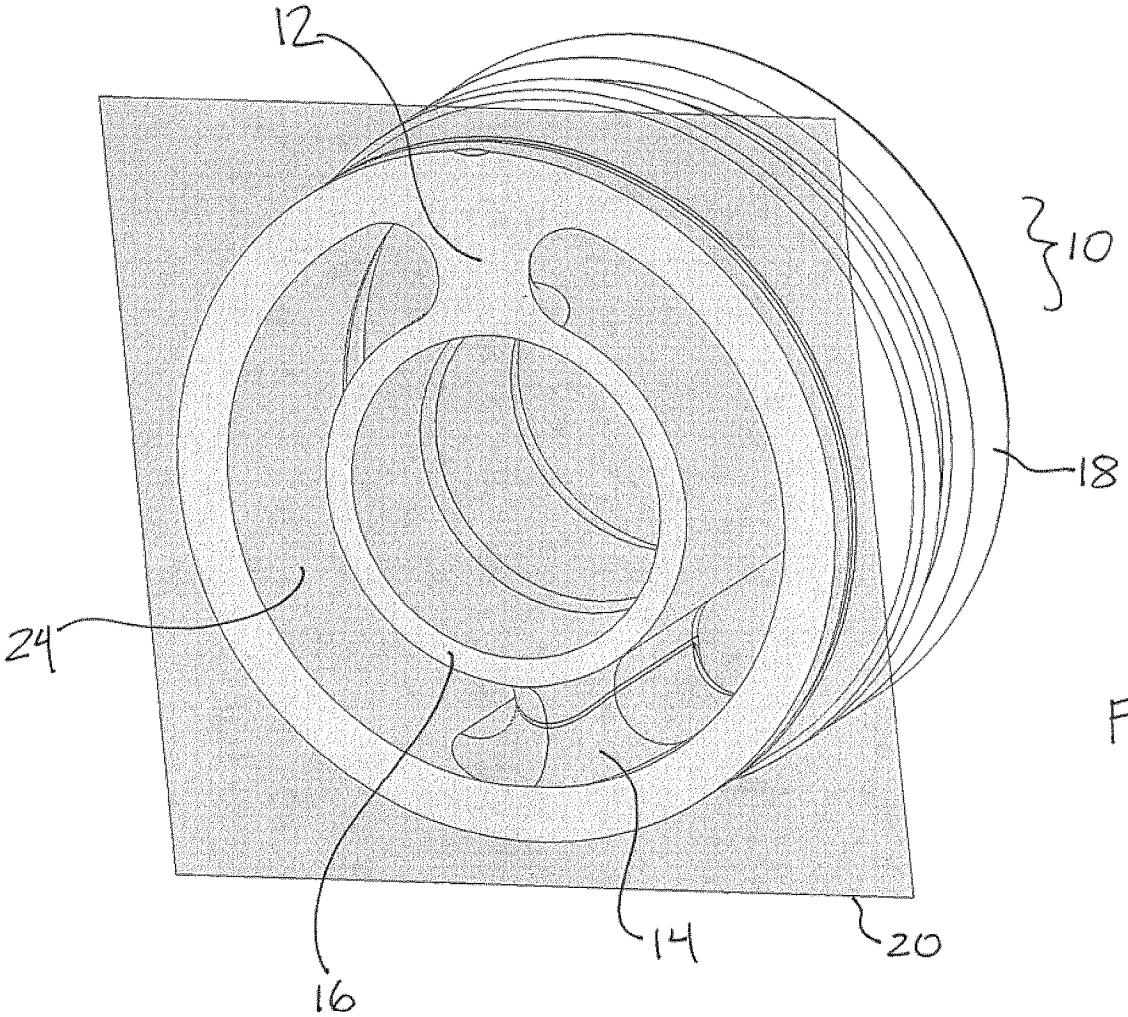
Figure 1D:
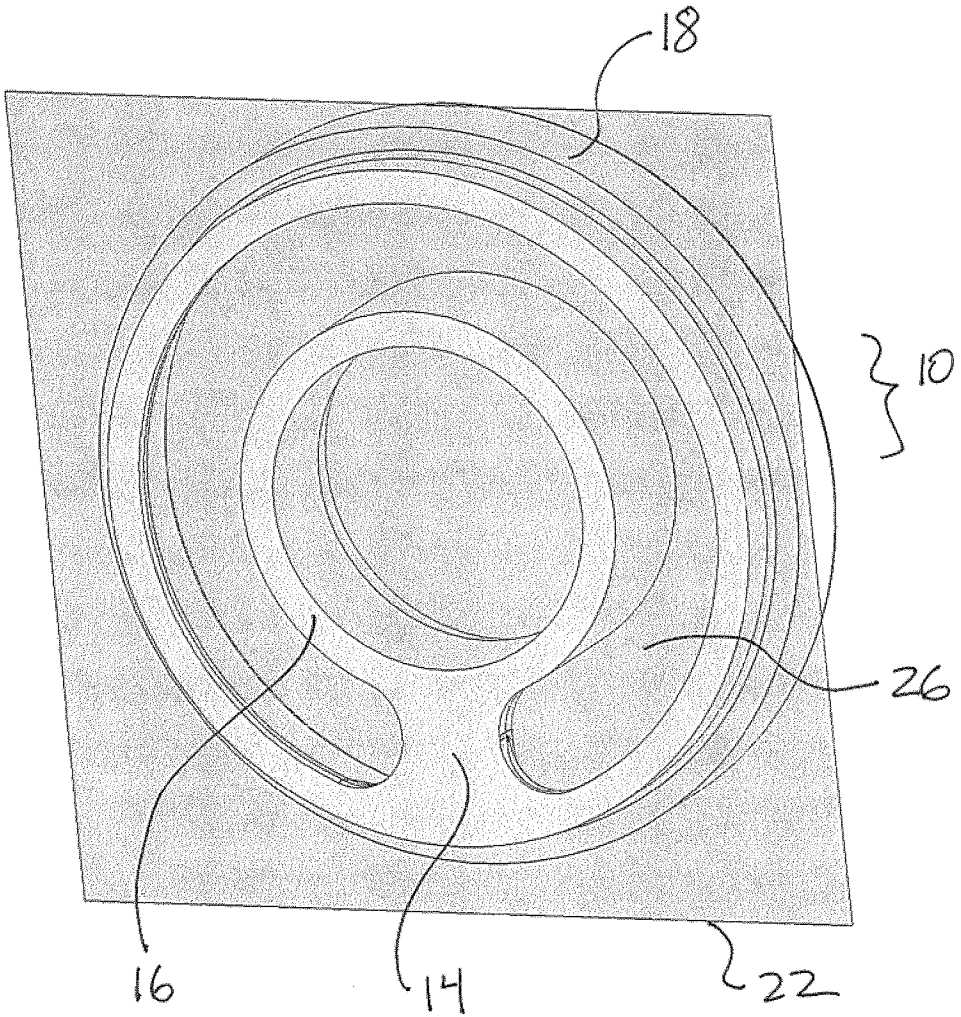
Figure 2:
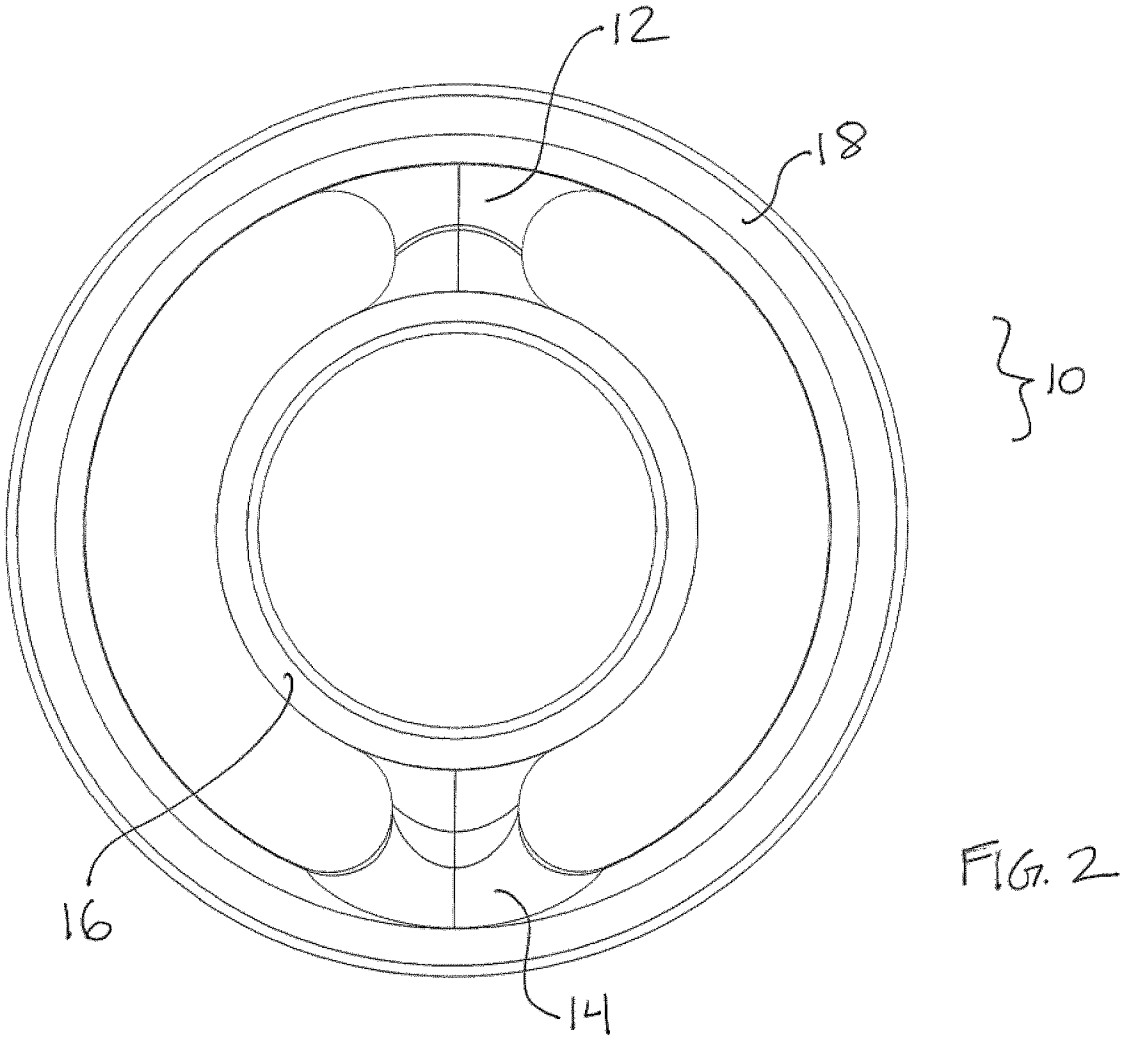
FIG. 2 is a front end view of the spider according to the first embodiment.
Figure 3A:
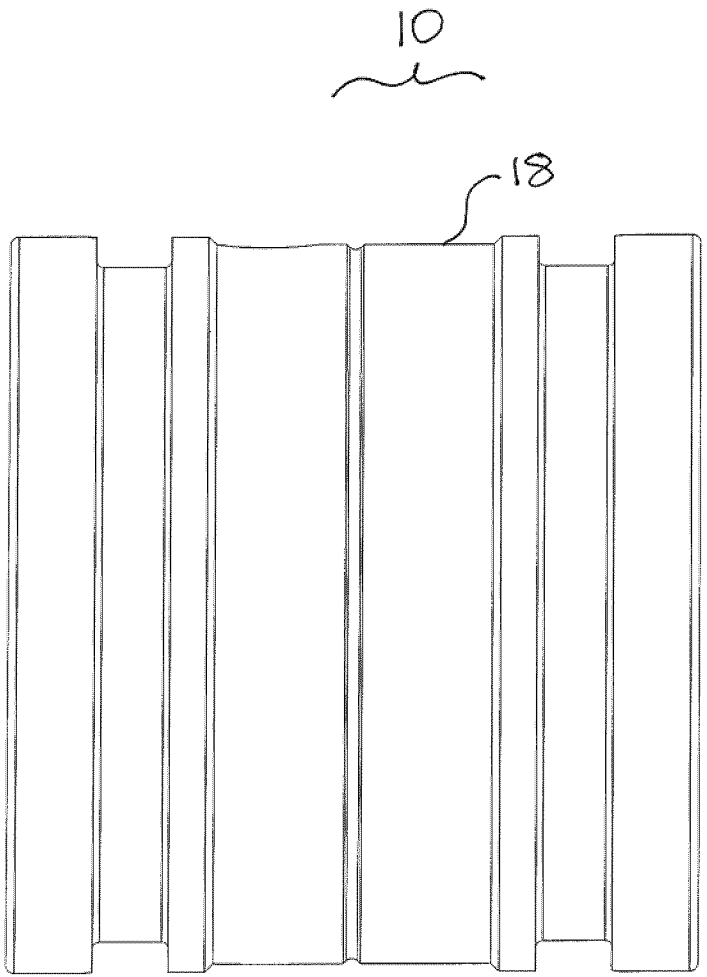
FIG. 3(*a*) is a side view of the spider according to the first embodiment.
Figure 3B:
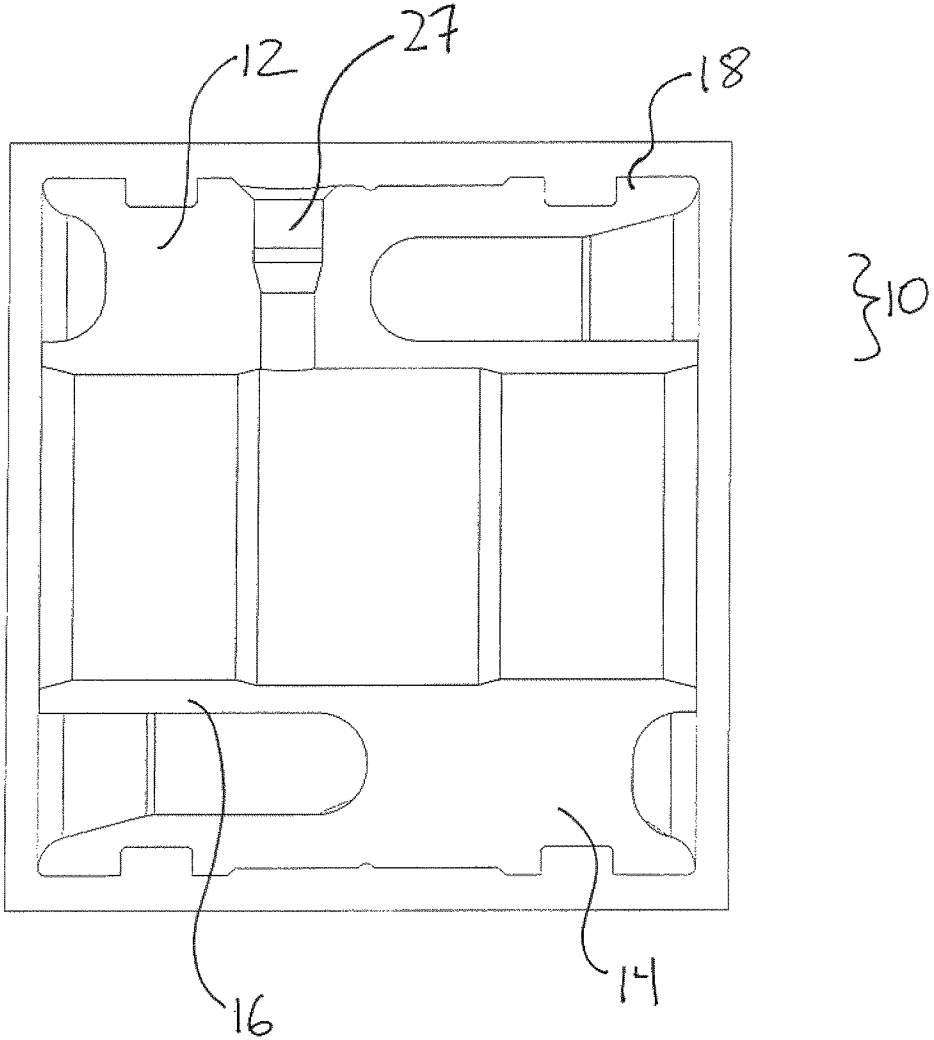

Referring now to FIGS. 1 to 3 and according to a first embodiment, a spider 10 for a MWD tool (not shown) comprises two axially offset spokes 12, 14 that join an inner rim 16 to an outer rim 18. A first spoke 12 is located in a first row and a second spoke 14 is located in a second row that is in a different axial location from the first row. More particularly, the second row is located at a drilling fluid inlet end of the spider 10, and the first row is located at a drilling fluid outlet end of the spider 10. The rows are axially located so that there is no overlap between the axial midpoint of each row (hereinafter, reference to spokes or rows of spokes being axially offset mean that the axial midpoints of the spokes or rows of spokes do not overlap, even if other parts of the spokes or rows of spokes partially overlap). As a result, first and second transverse planes 20, 22 extending respectively through the first and second midpoints each only have one spoke, and respectively define first and second flow areas 24, 26 that are associated with the first and second rows.

Axially offsetting the rows of spokes may cause the spider 10 to be longer than a spider having only one row of axially aligned spokes. The benefit of axially separating the rows should be weighed against certain design constraints on the spider 10. In particular, any spider will impose a flow restriction within a drill collar which will lead to a pressure drop therein; a larger pressure drop will result in greater difficulty for a drilling rig to pump drilling fluid through the drill string. Therefore, when selecting the amount of axial separation between rows of spokes, the benefits of minimizing the length of the spider to minimize the flow restriction caused by the spider should be weighed against the benefit of lengthening the spider 10 to accommodate the axially offset rows of spokes.

As can be most clearly seen in FIG. 2, the second spoke 14 is radially spaced 180° from the first spoke 12. This arrangement is expected to provide a particular stable connection between the inner and outer rims 16, 18; however, the spokes 12, 14 can be arranged at different radial angles from one another, and particularly anywhere between 90 and 270 degrees.

The first and second flow areas 24, 26 are each selected to equal or exceed a target flow area required for drilling fluid to flow through the spider at the minimum target flow rate, i.e. the minimum flow rate required to drive the drilling motor at a specified output and under specified operating conditions. As can be seen in FIGS. 1(*c*) and (*d*), the size of the flow area is defined by the radial distance between the inner and outer rims 16, 18, and the geometry of the portion of the spoke 12, 14 in the relevant transverse plane.

As the spider 10 only has one spoke in each transverse plane, it is apparent that thicker spokes 16, 18 can be used for the spider 10 compared to a conventional spider (not shown) that has two or more non-offset spokes in the same transverse plane, and which has the same flow area. The thicker spokes and/or rims are expected to produce a spider 10 that is stronger and more robust than a conventional non-offset spoke spider having the same number of spokes. For example, when compared to a conventional spider having two non-offset spokes and the same flow area, the spider 10 according to the first embodiment can have substantially thicker spokes 12, 14 for the same inner and outer rim diameters. It is also possible to design the spider 10 to have a larger inner rim diameter while keeping the flow area the same; this can be advantageous, for example, to allow larger diameter MWD tools, or to allow for a thicker and thus stronger inner rim.

Conversely, the spider 10 according to this embodiment can feature spokes of the same thickness as conventional non-offset spoke spiders having the same number of total spokes, in which case the flow area 24, 26 in each transverse plane 20, 22 would be substantially larger than the corresponding flow area in the conventional spider, since the spider 10 only has one spoke per transverse plane 20, 22. As a result, the spider 10 is expected to achieve a higher fluid flow rate rating than a conventional spider, which should allow the MWD tool to operate in a greater range of operating conditions.

Further, the spider can feature both thicker spokes and a larger flow area than a conventional non-offset spoke spider, thereby producing a more robust spider that can also flow a higher rate of drilling fluid, than a comparable conventional spider.

Optionally, the spider 10 can be provided with a pressure port 27 and o-ring grooves 28 which allow the drill collar to be hydraulically connected to the MWD in a manner known in the art.

Figure 4G:
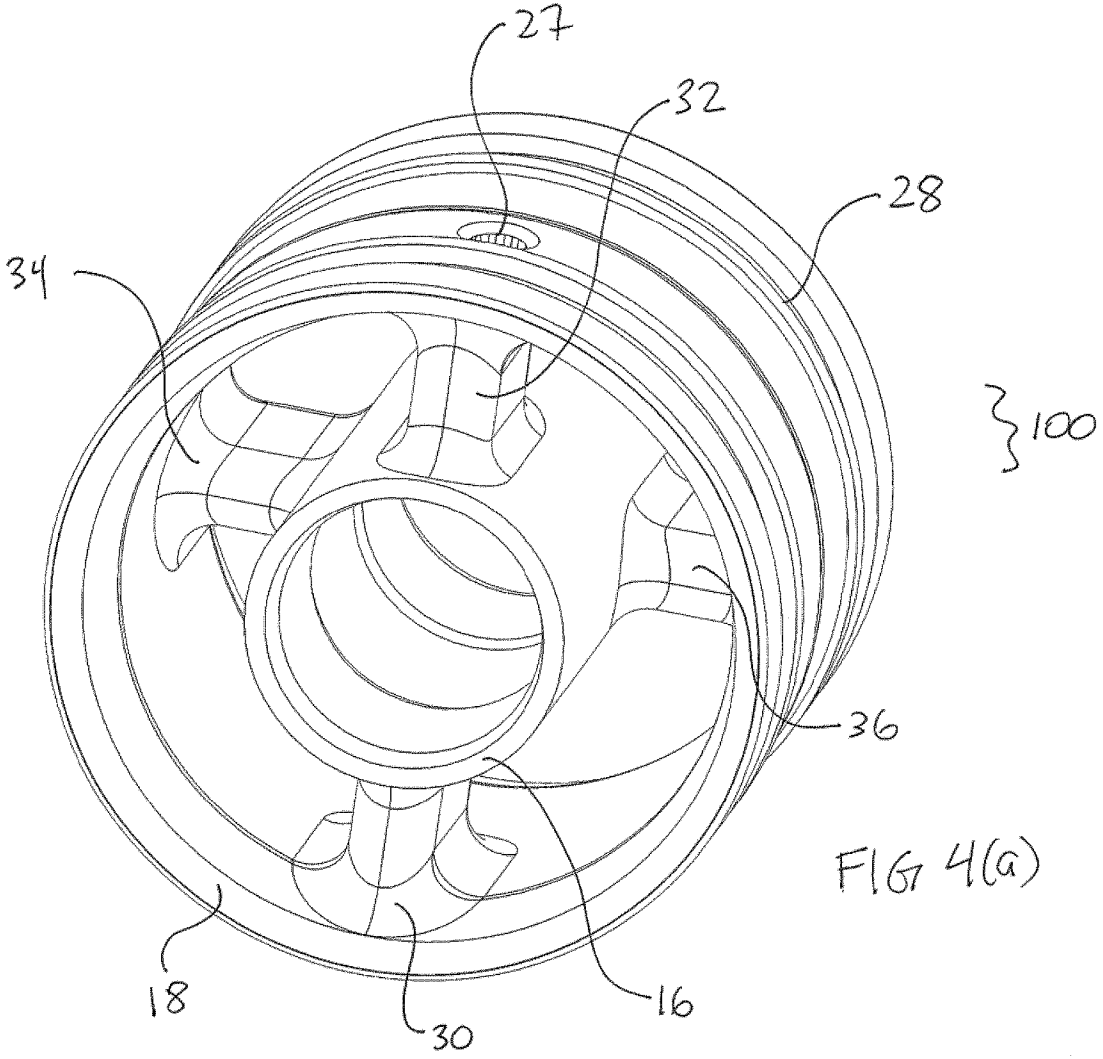
FIG. 4(*a*) is a perspective view of an offset four-spoke spider for a downhole tool according to a second embodiment.
Figure 4B:
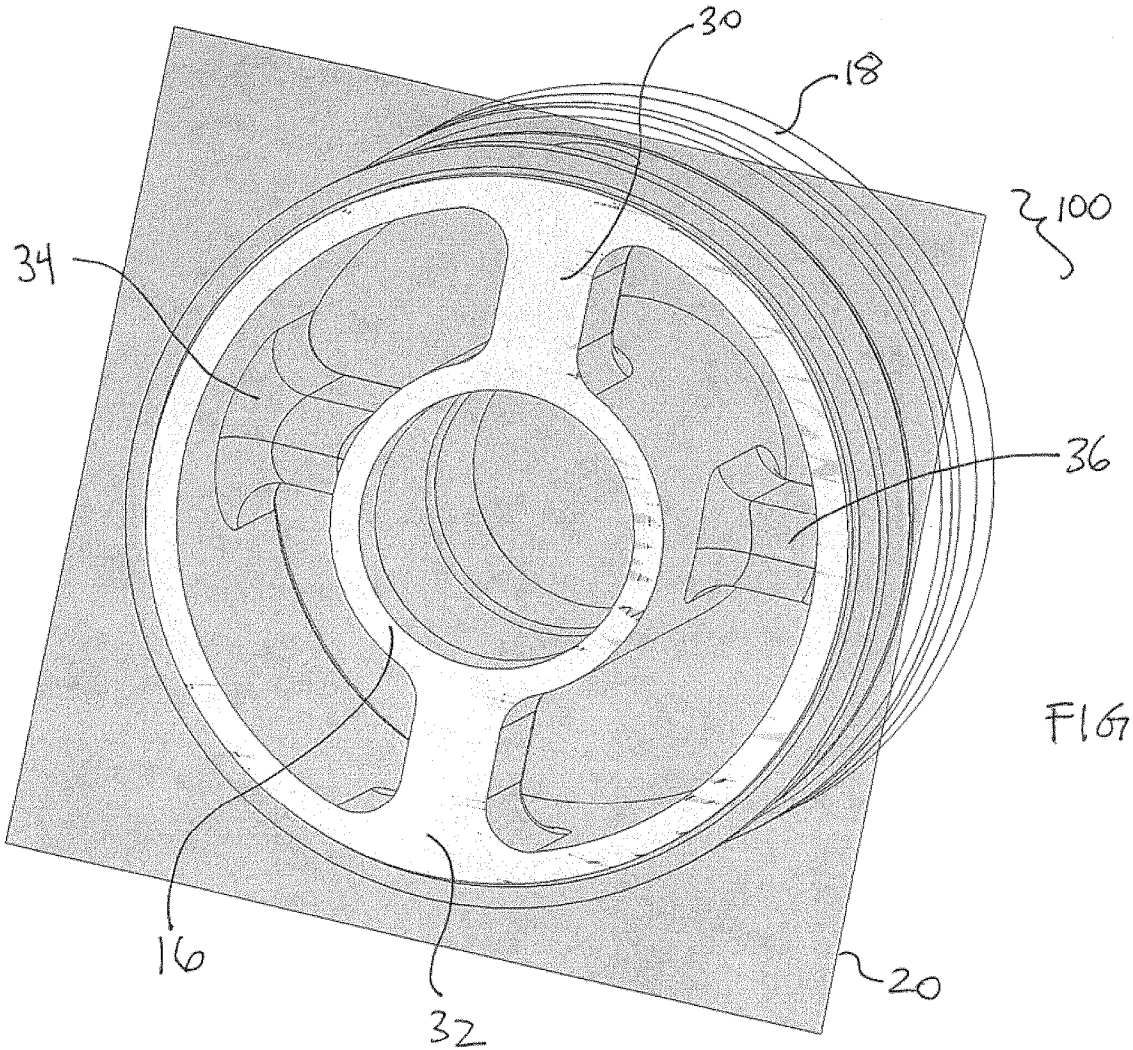
Figure 4C:
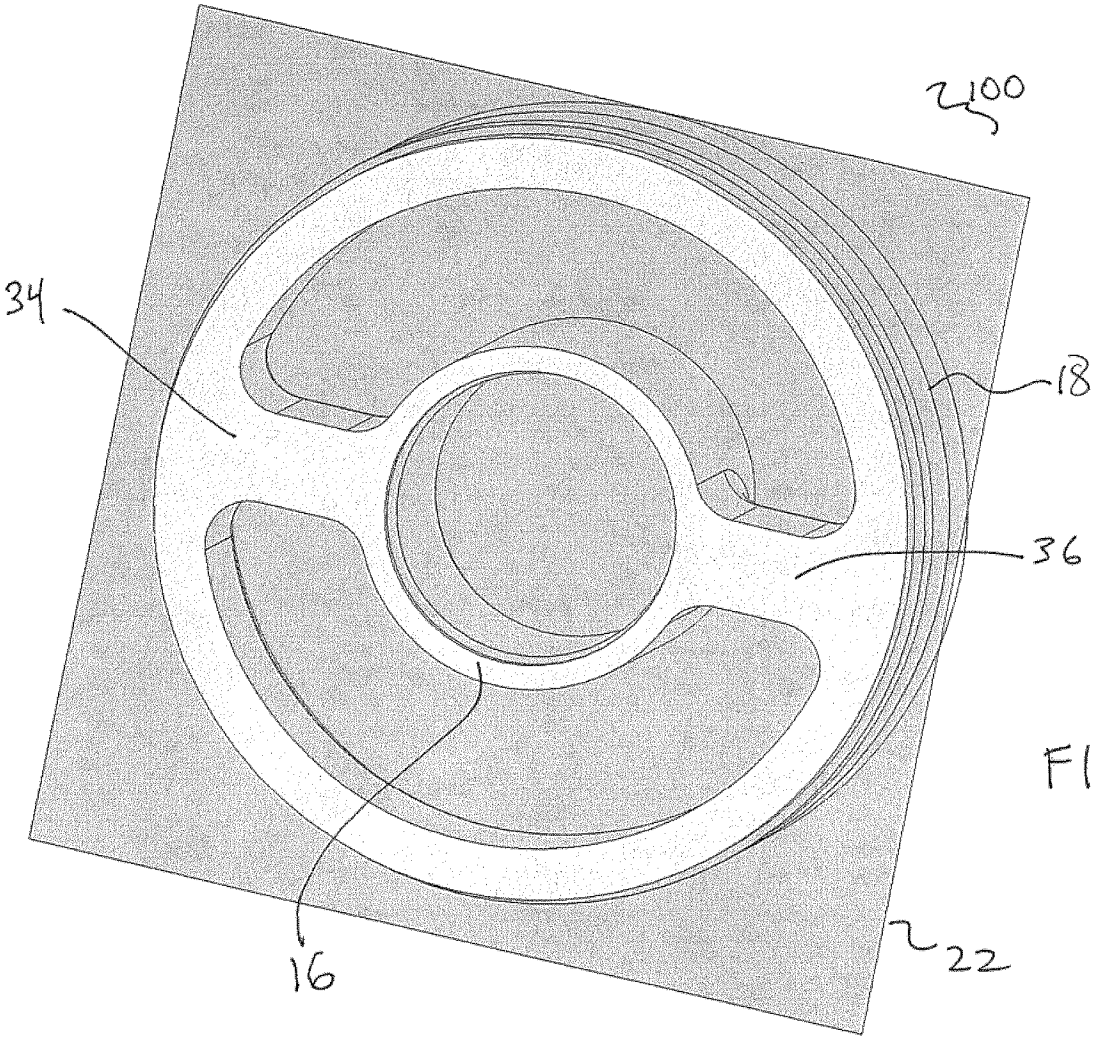
Figure 5:
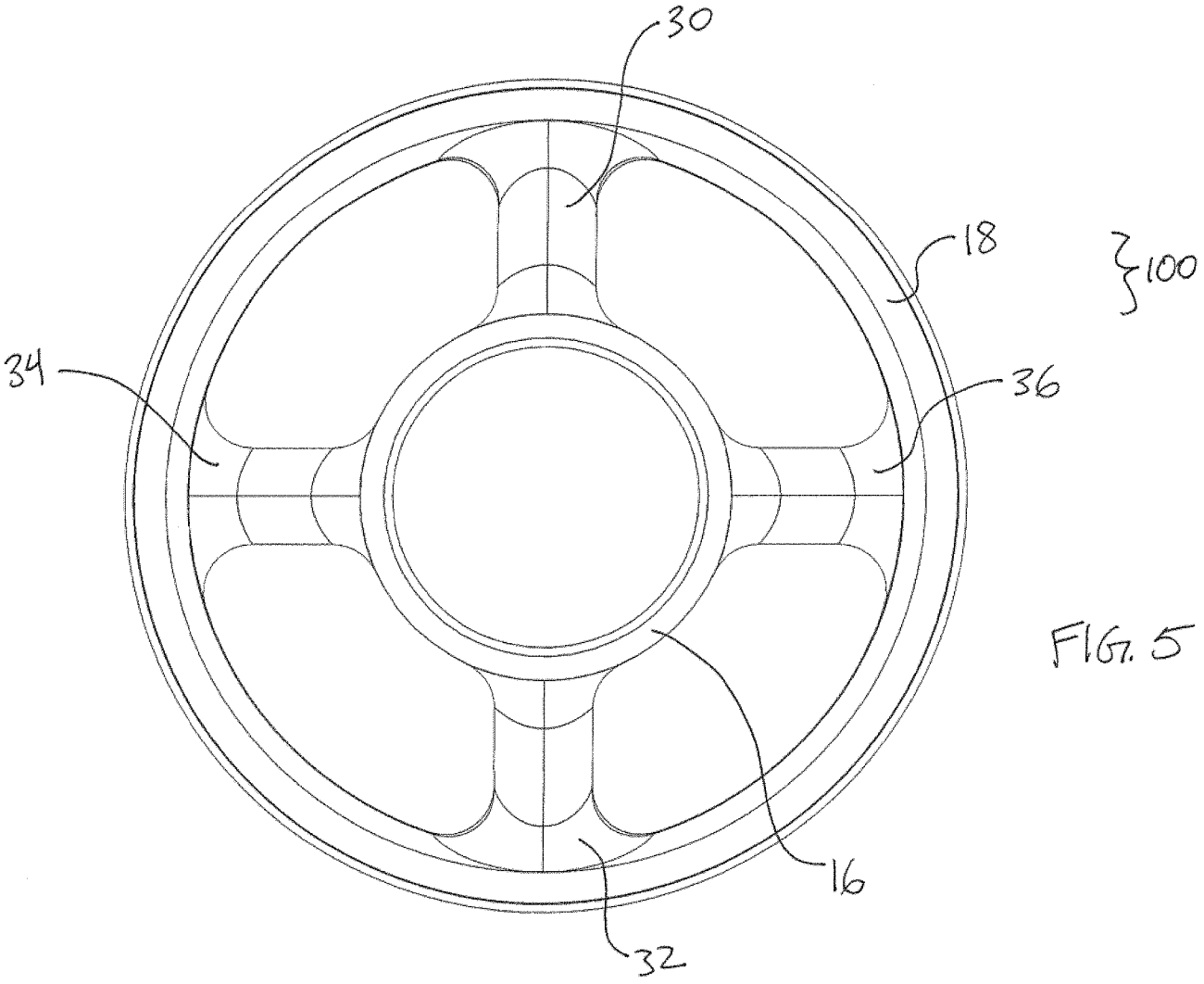
FIG. 5 is a front end view of the spider according to the second embodiment.
Figure 6A:
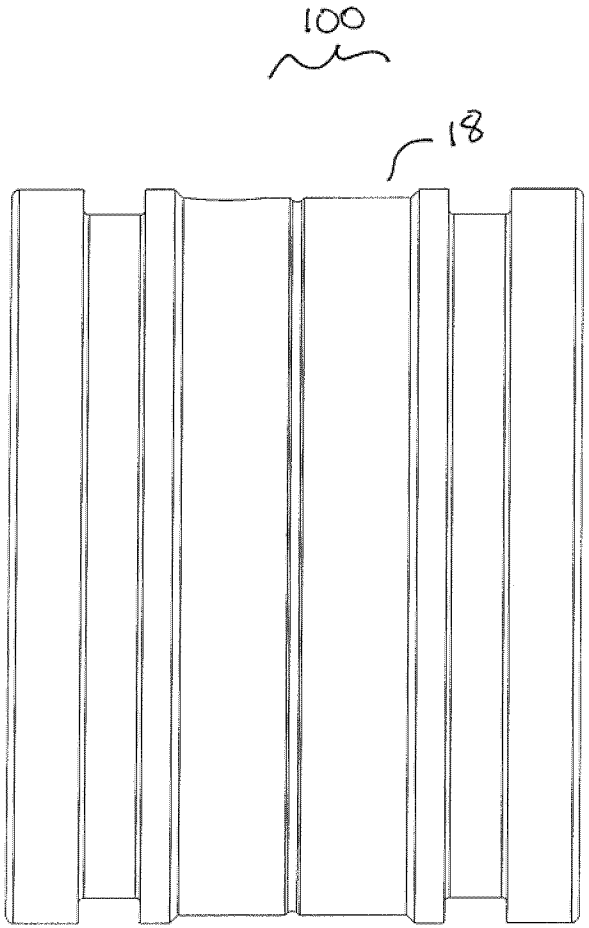
FIG. 6(*a*) is a side view of the spider according to the second embodiment.
Figure 6B:
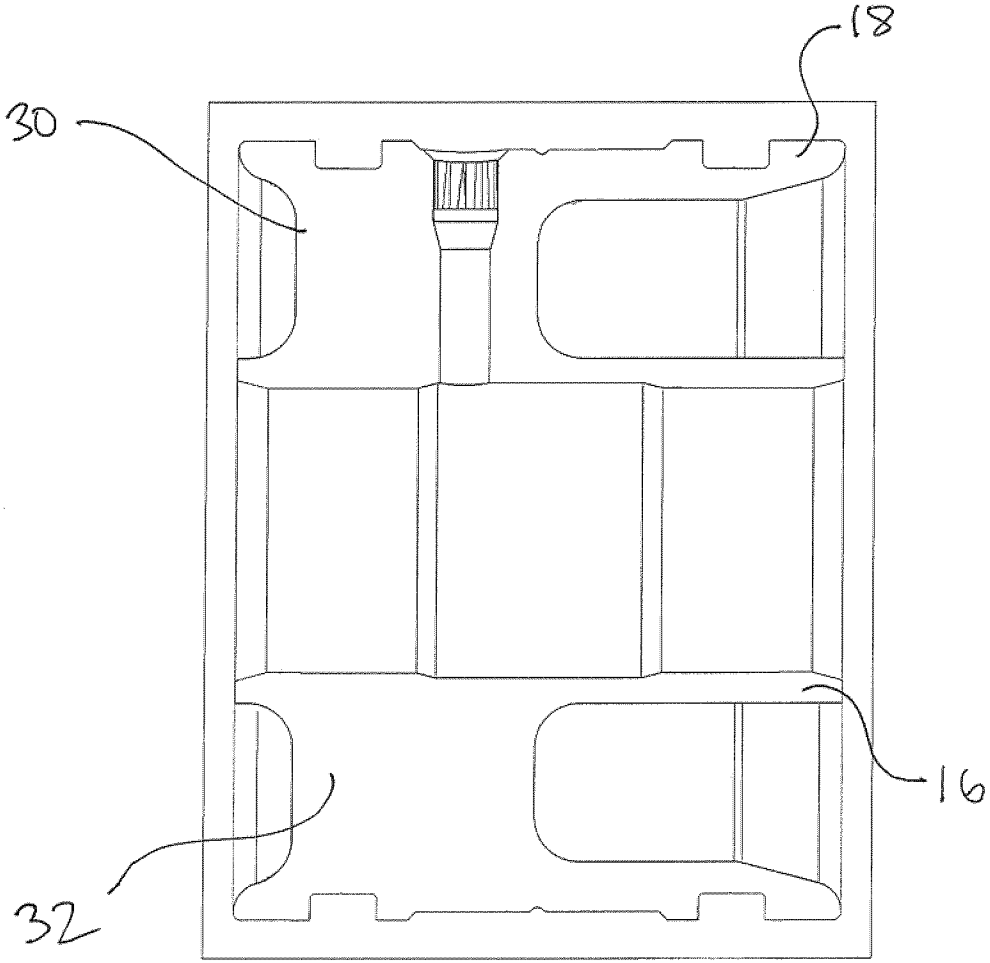

Referring now to FIGS. 4 to 6, a second embodiment of the spider 100 is the same as the first embodiment 10 except that there are two spokes 30, 32, 34, 36 per row. Each pair of spokes 30, 32/34, 36 are circumferentially spaced 180° from each other, thereby defining two separate openings of equal flow areas. This radial spacing is expected to provide a particularly stable connection between the inner and outer rims 16, 18; however, the radial angle between each pair of spoke 30, 32/34, 36 can be different.

The pair of spokes 34, 36 in the second row are circumferentially offset 90° from the pair of spokes 30, 32 in the first row. Again, this configuration is expected to be particularly stable but other configurations may be possible that will meet the operating design criteria for the spider.

Like the first embodiment, the flow area of the transverse planes 20, 22 of the first and second rows are selected to meet or exceed the minimum flow area required to achieve the target drilling fluid flow rate. The second embodiment of the spider 100 can be compared favourably to a conventional spider having four non-offset spokes, wherein the spokes of the spider 100 can be made thicker than the spokes of the conventional spider and still achieve the same flow area, or, the spider 100 can provide a greater flow area compared to a conventional spider when both spiders have spokes with the same geometry and dimensions.

While the present invention has been described herein by the preferred embodiments, it will be understood by those skilled in the art that various consistent and now obvious changes may be made and added to the invention. For example, while both embodiments of the spider 10, 100 feature only two rows of spokes, other embodiments (not shown) can feature more than two rows of spokes. Also, embodiments (not shown) can feature more than two spokes per row. The one or more spokes in each row can be circumferentially offset from the one or more spokes in other rows, and in particular, the circumferential offset between each spoke in all rows can be circumferentially equidistant from each other. For spiders having two or more spokes per row, the spokes in each row can be circumferentially equidistant from one another. For example, a spider (not shown) can be provided having three rows of spokes, wherein each row has one spoke, and the spokes are radially spaced 120 degrees from each other.

The scope of the claims should not be limited by the preferred embodiments set forth in the examples, but should be given the broadest interpretation consistent with the description as a whole.

EXAMPLE 1

A 6.5" OD spider according to an embodiment of the invention has four spokes arranged in two axially offset pairs. This spider has a material composition of steel alloy optionally coated with tungsten carbide to increase erosion protection. The spokes in each pair are circumferentially spaced 180° apart. The pairs of spokes are axially offset by 1.266" (the leading edge of the second row of spokes is starting 0.032" behind the trailing edge level of first row of spokes) and the second pair of spokes is circumferentially offset from the first pair of spokes by 90°. The neck (inner rim) diameter is 1.437" and each spoke has a thickness of 0.375" resulting in a flow area of 3.8382 $in^2$ in the transverse plane for each row of spokes (axial mid-point of each spoke). This flow area and the offset spoke geometry is expected to result in a flow rate of 528 GPM for drilling fluid flowing through the spider under the following conditions: Recommended Max. Flow Rate 2.0 m cub/min (528 GPM); drilling fluid: Water-Based Mud/Oil-Based Mud/Air; Max. Sand Content by Volume 2%; Max. LCM Content: no limits. A comparable conventional (non-offset spoke) 6.5" OD spider also has a flow rating of 528 GPM and has three spokes in the same transverse plane that are circumferentially spaced 60° apart. To achieve this flow rating, the spider must have a flow area of 3.9982 $in^2$ which results in a spoke thickness of 0.375" and a neck diameter of 1.125", which is substantially smaller than the neck diameter of the spider with the offset spoke pairs.

EXAMPLE 2

A 4.5" OD spider according to an embodiment of the invention has two spokes with each spoke axially offset by 1.250" (the leading edge of the second row of spokes is starting from the trailing edge level of first row of spokes) and circumferentially offset by 180°. The neck diameter is 1.437" and each spoke has a thickness of 0.375" resulting in a flow area of 2.0603 $in^2$ in the transverse plane for each row of spokes (axial mid-point of each spoke). This flow area and the offset spoke geometry is expected to result in a flow rate of 317 GPM for drilling fluid flowing through the spider under the following conditions: Recommended Max. Flow Rate 1.2 m cub/min (317 GPM); drilling fluid: Water-Based Mud/Oil-Based Mud/Air; Max. Sand Content by Volume 2%; Max. LCM Content: no limits.

A comparable conventional (non-offset spoke) 4.5" OD spider also has a flow rating of 317 GPM and has three spokes in the same transverse plane that are circumferentially spaced 60° apart. To achieve this flow rating, the spider must have a flow area of 2.196 $in^2$ which results in a spoke thickness of 0.375" and a neck diameter of 1.125", which is substantially smaller than the neck diameter of the spider with the offset spoke pairs.

What is claimed is:

1. A spider for a downhole tool, comprising:
(a) an inner rim;
(b) an outer rim; and
(c) at least two spokes extending radially between and connected to the inner and outer rims, the at least two spokes comprising a first spoke in a first row and a second spoke in a second row that is axially offset from the first row, the first spoke is a single spoke in the first row and the second spoke is a single spoke in the second row;
wherein each row defines a transverse plane having a flow area that is sufficient for drilling fluid flowing through the spider to at least meet a minimum target flow rate under specified operating conditions.

2. A spider as claimed in claim 1 wherein the second spoke is circumferentially offset from the first spoke.

3. A spider as claimed in claim 2 wherein the spider has a single spoke per row.

4. A spider as claimed in claim 3 wherein the spider comprises only two spokes, namely a single first spoke in the first row and a single second spoke in a second row.

5. A spider as claimed in claim 4 wherein the second spoke is circumferentially offset from the first spoke by an angle between 90 and 270 degrees.

6. A spider as claimed in claim 5 wherein the second spoke is circumferentially offset from the first spoke by an angle of about 180 degrees.

7. A spider as claimed in claim 1 wherein the second row is at a drilling fluid inlet end of the spider.

8. A spider as claimed in claim 7 wherein the first row is at a drilling fluid outlet end of the spider.

9. A spider as claimed in claim 1 selected from a group consisting of grounding spiders, landing spiders, and centralizers.

10. A spider as claimed in claim 1 wherein the second row is at a drilling fluid inlet end of the spider, and the first row is at a drilling fluid outlet end of the spider.

11. A spider as claimed in claim 1 further comprising a pressure port.

12. A spider as claimed in claim 1 further comprising one or more o-ring grooves in an outer surface of the outer rim.

13. A downhole tool, comprising:
a drill collar;
a spider coupled to the drill collar, the spider including:
an outer rim connected to the drill collar;
an inner rim radially within the outer rim; and
at least two spokes extending radially between and connected to the inner and outer rims, the at least two spokes comprising a first spoke in a first row and a second spoke in a second row that is axially offset from the first row;
wherein each row defines a transverse plane having a flow area that is sufficient for drilling fluid flowing through the spider to at least meet a minimum target flow rate under specified operating conditions.

14. A downhole tool as claimed in claim 13 wherein the spider has a single spoke per row.

15. A downhole tool as claimed in claim 14 wherein the spider comprises only two spokes, namely a single first spoke in the first row and a single second spoke in a second row.

16. A downhole tool as claimed in claim 13 wherein the spider has two spokes per row.

17. A downhole tool as claimed in claim 16 wherein the spider comprises four spokes, namely a first pair of spokes in the first row and a second pair of spokes in the second row.

18. A downhole tool as claimed in claim 13 the spider further comprising one or more o-ring grooves in the outer rim and further comprising an o-ring seated in one of the one or more o-ring grooves in the outer rim.

19. A downhole tool as claimed in claim 13 further comprising a pressure port.

20. A spider for a downhole tool comprising:

an outer rim having one or more o-ring grooves in an outer surface of the outer rim;

an inner rim; and at least two spokes extending radially between and connected to the inner and outer rims, the at least two spokes comprising a first spoke in a first row and a second spoke in a second row that is axially offset from the first row;

wherein each row defines a transverse plane having a flow area that is sufficient for drilling fluid flowing through the spider to at least meet a minimum target flow rate under specified operating conditions.

* * * * *